US009127905B2

(12) United States Patent
Schreckenstein et al.

(10) Patent No.: US 9,127,905 B2
(45) Date of Patent: Sep. 8, 2015

(54) RECEIVER SPUR FOR A FIREARM

(71) Applicants: William Thomas Schreckenstein, Munnsville, NY (US); Stephen Elmer Byron, Munnsville, NY (US)

(72) Inventors: William Thomas Schreckenstein, Munnsville, NY (US); Stephen Elmer Byron, Munnsville, NY (US)

( * ) Notice: Subject to any disclaimer, the term of this patent is extended or adjusted under 35 U.S.C. 154(b) by 70 days.

(21) Appl. No.: 14/031,355

(22) Filed: Sep. 19, 2013

(65) Prior Publication Data

US 2014/0259850 A1 Sep. 18, 2014

Related U.S. Application Data

(60) Provisional application No. 61/787,577, filed on Mar. 15, 2013.

(51) Int. Cl.
*F41C 23/12* (2006.01)

(52) U.S. Cl.
CPC ..... *F41C 23/12* (2013.01)

(58) Field of Classification Search
CPC ..... F41C 23/02; F41C 23/10; F41C 23/12; F41C 23/14; F41C 27/00; F41C 33/006; F41C 33/007; F41C 33/08; F41C 11/02
USPC ..... 42/71.01–71.02, 75.01–75.03, 85, 106, 42/72–73
See application file for complete search history.

(56) References Cited

U.S. PATENT DOCUMENTS

| | | | | |
|---|---|---|---|---|
| 4,630,387 | A * | 12/1986 | Crane et al. | 42/73 |
| 4,884,354 | A * | 12/1989 | Senfter | 42/73 |
| 7,941,956 | B2 * | 5/2011 | Carr et al. | 42/73 |
| 8,127,658 | B1 * | 3/2012 | Cottle | 89/140 |
| 8,601,734 | B1 * | 12/2013 | Hopkins et al. | 42/73 |
| 8,769,854 | B1 * | 7/2014 | Battaglia | 42/75.03 |
| 8,857,094 | B2 * | 10/2014 | Michel | 42/73 |
| D717,903 | S * | 11/2014 | Prince | D22/108 |
| 2002/0170224 | A1 * | 11/2002 | Lawless | 42/71.02 |
| 2003/0140542 | A1 * | 7/2003 | Kay | 42/75.03 |
| 2009/0126249 | A1 * | 5/2009 | Crommett | 42/71.01 |
| 2009/0288324 | A1 * | 11/2009 | Peterson et al. | 42/75.03 |
| 2010/0162608 | A1 * | 7/2010 | McCann | 42/71.01 |
| 2010/0212205 | A1 * | 8/2010 | Nill | 42/73 |
| 2010/0281741 | A1 * | 11/2010 | Gibson et al. | 42/71.02 |
| 2011/0061284 | A1 * | 3/2011 | Cabahug et al. | 42/73 |
| 2011/0283581 | A1 * | 11/2011 | Freed | 42/49.01 |
| 2011/0283583 | A1 * | 11/2011 | Freed | 42/71.01 |
| 2013/0047482 | A1 * | 2/2013 | Mulfinger | 42/84 |
| 2013/0340312 | A1 * | 12/2013 | Fulton et al. | 42/73 |
| 2014/0144060 | A1 * | 5/2014 | Thordsen | 42/73 |
| 2014/0259850 | A1 * | 9/2014 | Schreckenstein et al. | 42/75.03 |

OTHER PUBLICATIONS

Linoge, Exile Machine's Hammerhead AR-15 Rifle GRip, Jul. 26, 2010, Walls of the City, pp. 1-2.*
Exile Machine "Hammerhead" CA-Legal AR-15 Stock Adapter, Jun. 22, 2010, Calguns.net, pp. 1-3.*

* cited by examiner

*Primary Examiner* — Stephen M Johnson
*Assistant Examiner* — Benjamin Gomberg

(57) ABSTRACT

A receiver spur adapted to be mounted behind the trigger and the trigger guard of a firearm such as the AR-15. The spur is configured to substantially conformingly abut the surface of the receiver immediately behind the trigger guard and is secured to the receiver.

12 Claims, 11 Drawing Sheets

RECEIVER SPUR FOR A FIREARM

CROSS-REFERENCE TO RELATED APPLICATIONS

The present application claims the benefit of priority to U.S. Provisional Patent Application Ser. No. 61/787,577, filed Mar. 15, 2013, entitled "RECEIVER SPUR ESPECIALLY ADAPTED FOR USE WITH AN AR-15 STYLE FIREARM", the subject matter of which is hereby incorporated by reference.

FIELD OF THE INVENTION

The present invention relates to firearms, and more particularly to a receiver spur for use with firearms, especially for use with an AR-15 style firearm.

BACKGROUND OF THE INVENTION

The AR-15 firearm has been one of the most popular firearms in the United States, with both rifle and pistol configurations and versions for military use and civil use. The original AR-15 was designed and built by ArmaLite as an assault rifle for the United States armed forces. ArmaLite later sold its design to Colt, which made a few modifications to the design. The redesigned rifle was known as the M16 and became the United States military's standard service rifle during and since the Viet Nam War. The term AR-15 has been the Colt trademark for the civilian, semi-automatic versions of that design. Other manufacturers have made firearms having similar designs, but under different trademarks. Such similar designs include designs with different lengths and configurations of stocks and different barrel lengths. Further, due to the firearm's modular design, the upper portion of the receiver can be quickly and easily replaced with another upper receiver designed to accommodate different calibers of cartridges as well as associated barrels adapted to function with those different calibers of cartridges.

States within the United States have recently enacted laws that restrict the characteristics of so-called "assault weapons", including semi-automatic firearms such as the AR-15 firearm. Notably, the state of California has banned the civilian possession of semi-automatic, centerfire rifles that have the capacity to accept a detachable magazine and possess a "pistol grip that protrudes conspicuously beneath the action of the weapon", which is defined as meaning "a grip that allows for a pistol style grasp in which the web of the trigger hand (between the thumb and index finger) can be placed below the top exposed portion of the trigger while firing."

The AR-15 style firearms heretofore manufactured are typically provided with pistol type grip that places the web of the trigger hand in a position that extends below the upper, exposed portion of the trigger.

The present invention was designed to provide a spur that may be substituted for or may replace a typical pistol grip employed with AR-15 style firearms, but which may be advantageously employed in other firearms as well. The spur is believed to avoid the aforementioned legal characteristic that results in such firearms being banned from civilian possession.

SUMMARY OF THE INVENTION

The present invention relates to a receiver spur adapted to be mounted behind the trigger and the trigger guard of a firearm such as the AR-15. The spur is configured to substantially conformingly abut the surface of the receiver immediately behind the trigger guard and is secured to the receiver.

BRIEF DESCRIPTION OF THE DRAWINGS

The present invention will be described with reference to the accompanying drawings wherein:

FIG. 6 comprises several drawings depicting a receiver spur according to a preferred embodiment of the present invention;

DESCRIPTION OF A PREFERRED EMBODIMENT

Figure 1:
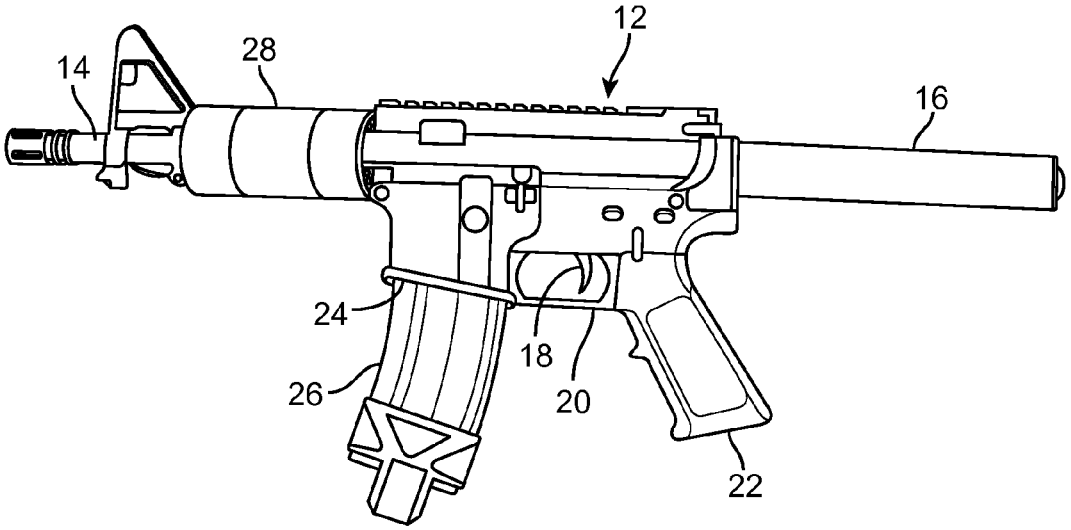
FIG. 1 (PRIOR ART)
FIG. 1 is a side view of a version of a conventional, prior art AR-15 firearm.

The present invention will be described with reference to the accompanying drawings wherein like reference numerals refer to the same item.

There shown in FIG. 1 a conventional, prior art AR-15 firearm, which generally includes a centrally disposed frame, housing, or receiver 12, a barrel 14 extending forwardly from the upper portion of the receiver 12, a stock 16 extending rearwardly from the upper portion of the receiver 12, a trigger 18 depending from beneath the lower portion of the receiver 12 and movable in a rearward direction by means of a human finger to discharge a projectile from the barrel 14 of the firearm, a trigger guard 20 generally surrounding the trigger 18, which minimizes the potential for the trigger 18 being moved rearwardly through inadvertent contact with objects, a handle grip 22 connected to and depending from the underside of the lower portion of the receiver 12 in the region behind the trigger 18 and trigger guard 20, and a magazine opening or mouth 24 disposed on the underside of the lower portion of the receiver 12 immediately ahead of the trigger 18 and trigger guard 20. The magazine mouth 24 is adapted to selectively receive and secure a magazine box 26 that contains a plurality of cartridges designed to be fired in the receiver, thereby discharging a projectile from the cartridge and through the barrel 14 of the AR-15 firearm.

The operation of the AR-15 firearm is generally as follows. A person grasps the firearm with one hand around the handle grip 22 and the other hand around a hand guard or rail system 28 that surrounds the barrel 14. The person may then pull or squeeze the trigger 18 rearwardly with the index finger or forefinger of the hand grasping the hand grip 22. Squeezing of the trigger 18 causes cartridges within the firing chamber of the receiver 12 to be fired, thereby discharging a projectile or so-called bullet from the cartridge through the barrel 14 under high velocity. Cartridges within the magazine 26 are forced under spring bias serially into the firing chamber of the receiver 12, whereupon further squeezing of the trigger 18 causes such cartridges also to be fired and to discharge associated projectiles through the barrel 14 under high velocity. When the cartridges within the magazine 26 are depleted, the magazine 26 may be selectively detached from the lower portion of the receiver 12 and a new replacement magazine filled with cartridges may be inserted into the magazine mouth 24 and attached to the lower portion of the receiver 12. The AR-15 firearm may be discharged in a semi-automatic fashion, whereas the M-16 military version may be discharged in an automatic fashion, which means that the trigger 18 may be squeezed and held in a rearward position whereupon the cartridges in a magazine 16 will be fed into the firing chamber and fired serially, automatically in a quick succession.

Figure 2:
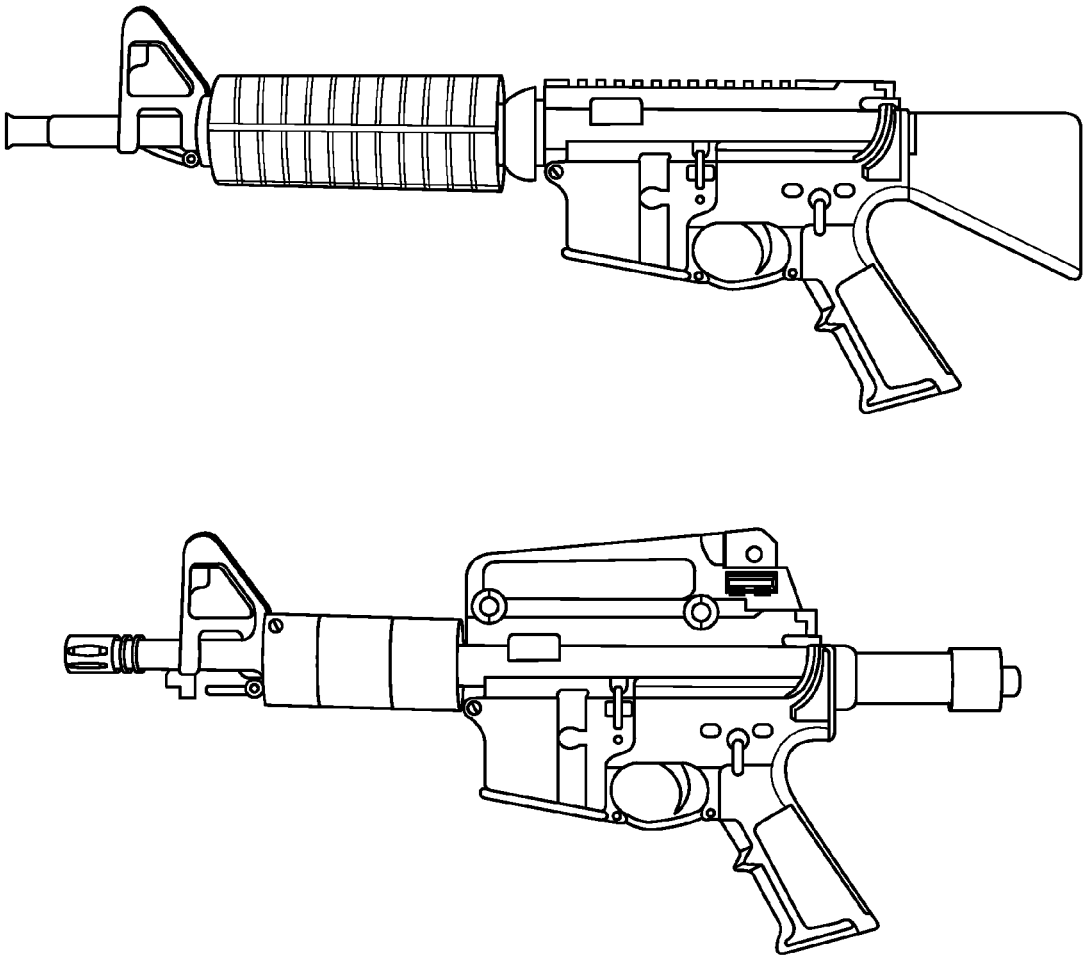
FIG. 2 (PRIOR ART)
FIG. 2 depicts side views of two other versions of a conventional, prior art AR-15 firearm.

FIG. 2 shows other versions of the AR-15 firearm in which the barrels, the stocks, the hand guards, carrying handles, and sights are different.

Figure 3:
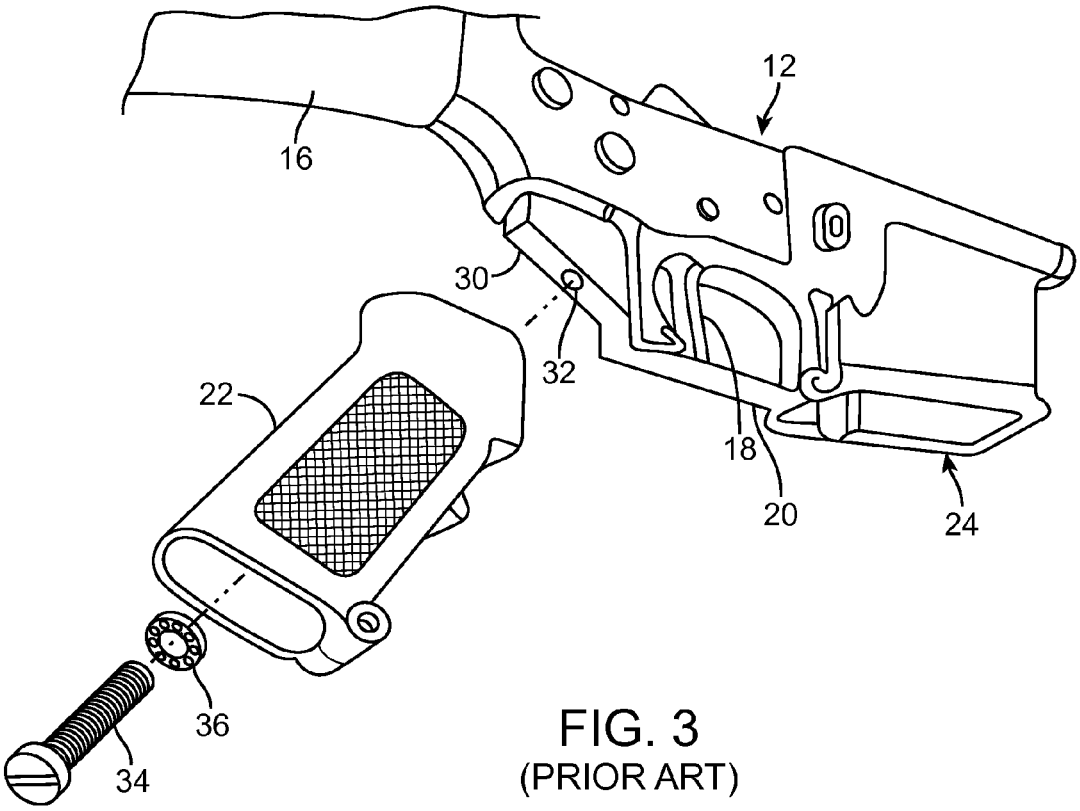
FIG. 3 (PRIOR ART)
FIG. 3 is a perspective illustration of a broken view of a lower portion of a receiver of an AR-15 firearm with an exploded illustration of the hand grip typically attached via a machine screw to an ear or lug depending from the lower portion of a receiver.
Figure 4:
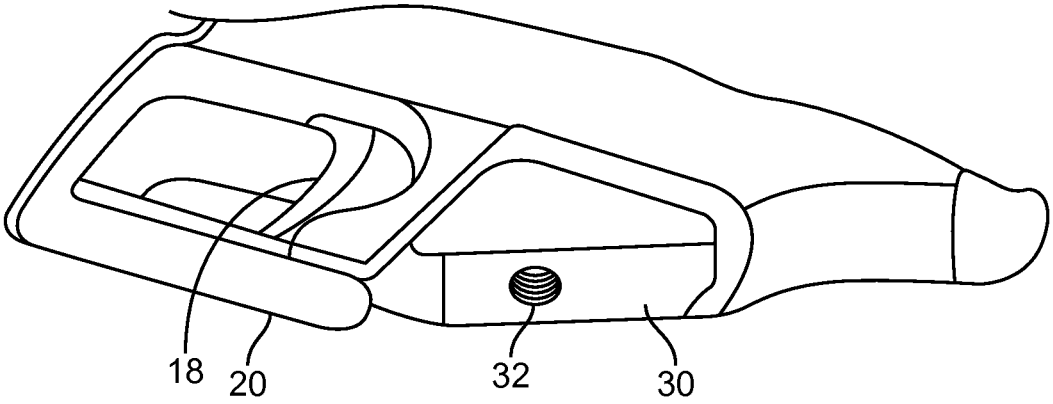
FIG. 4 (PRIOR ART)
FIG. 4 is a perspective illustration of a broken view the lower portion of a receiver of an AR-15 firearm.

FIG. 3 illustrates how the handle grip 22 is typically secured to the receiver 12 in a conventional, prior art AR-15 firearm. An ear or lug 32 depends from the underside of the lower portion of the receiver 12, immediately behind the trigger 18 and the trigger guard 20. The lug 30 possesses a slanted or beveled surface generally inclined rearwardly and upwardly toward the stock 16. A reverse view of the lug 30 is best shown in FIG. 4. The upper portion of the handle grip 22 possesses a cavity adapted to accept the lug 30. The lug 30 possesses a threaded hole 32 therein which is adapted to receive a machine screw or bolt 34 which extends through the handle grip 22 and then into the threaded hole 32 to selectively secure the handle grip 22 to the lower portion of the receiver 12. A washer 36 may circumscribe the shaft of the machine screw or bolt 34 and be disposed against the head of the machine screw or bolt 34 in a well-known manner to inhibit the machine screw or bolt 34 from rotating and loosening from disposition within the threaded hole 32.

Figure 5:
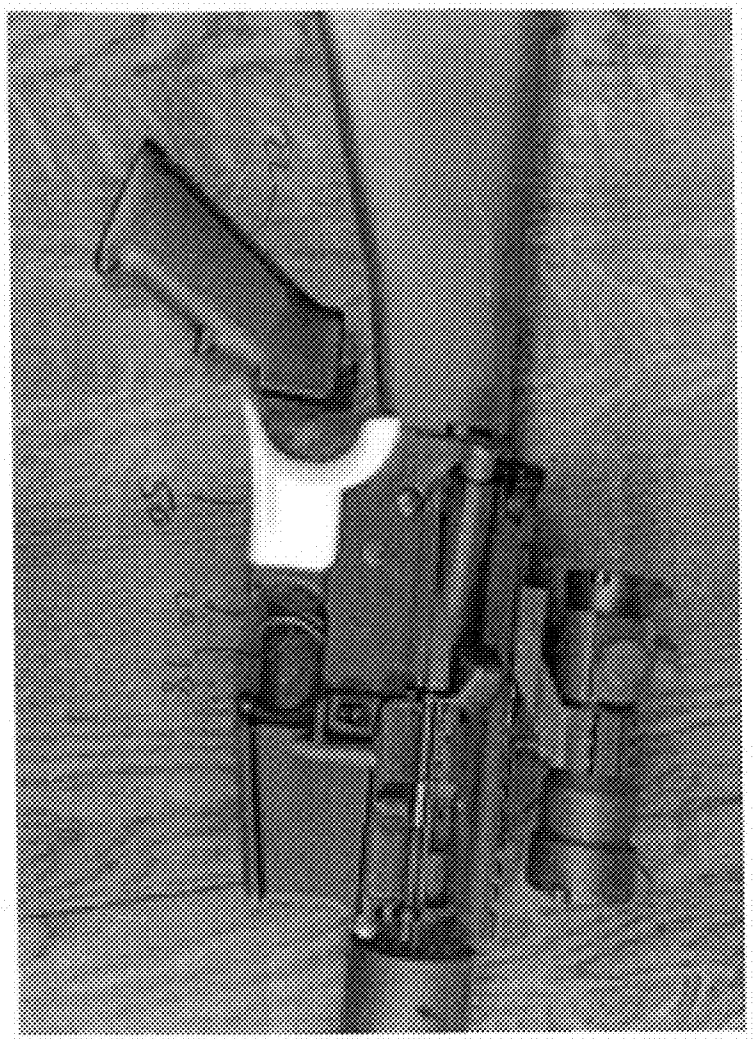
FIG. 5 is a side, partial view of the conventional, AR-15 firearm with the pistol grip shown in FIG. 3 detached as well as the receiver spur of a preferred embodiment of the present invention mounted thereto.

FIG. 5 depicts a receiver spur 50 in accordance with a preferred embodiment of the present invention. The receiver spur 50 is generally mounted to the lower rear portion of the receiver 12 immediately behind the trigger 18 and the trigger guard 20. FIG. 5 also depicts a detached handle grip 22 in a manner generally illustrating how the receiver spur 50 may replace the handle grip 22. As such, the receiver grip 50 may be retrofitted onto existing AR-15 firearms, or may be mounted to the receiver 12 as part of originally manufactured and distributed AR-15 firearms.

FIG. 6 illustrates in detail a receiver spur 50 in accordance with a preferred embodiment of the present invention. The receiver spur 50 includes a pair of spaced, substantially parallel, planar walls 52, 54 disposed on a front and upper portion thereof. The receiver spur 50 also includes an inwardly disposed beveled surface 56 extending between the walls 52, 54, as best shown in FIG. 6C. Together, the walls 52, 54 and the beveled surface 56 form an open cavity preferably adapted to conformingly receive and accept the lug 30 depending from the lower portion of the receiver 12. As such, the interior surfaces of the walls 52, 54 are preferably flat and parallel, and the beveled surface 56 is also preferably flat in a manner that substantially conforms with the configuration of the lug 30.

Figure 6A:
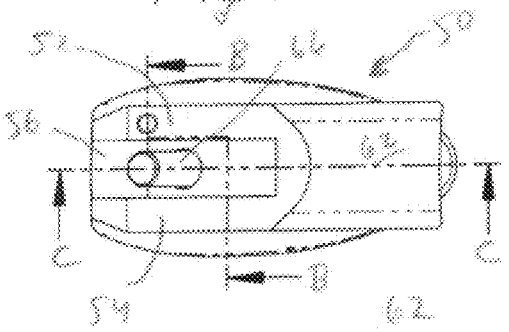
FIG. 6A is a top view of the spur.
Figure 6B:
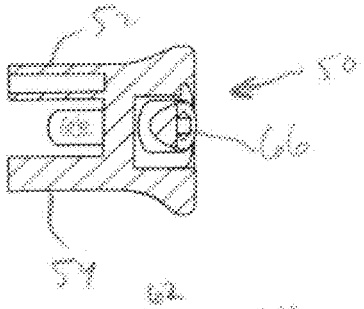
FIG. 6B is a cross-sectional view of the spur shown in FIG. 6A taken along the lines B-B.
Figure 6C:
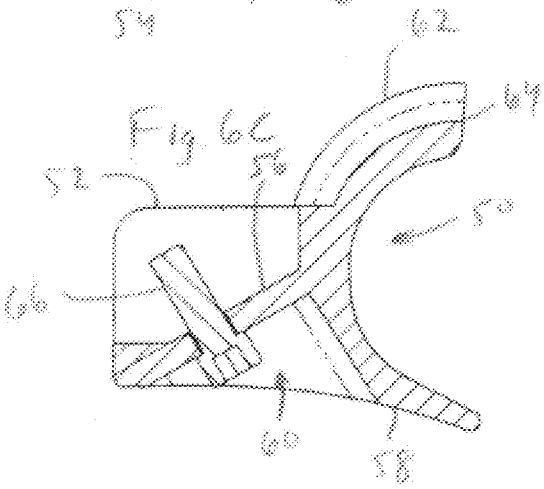
FIG. 6C is a cross-sectional view of the spur shown in FIG. 6A taken along the lines C-C.
Figure 6D:
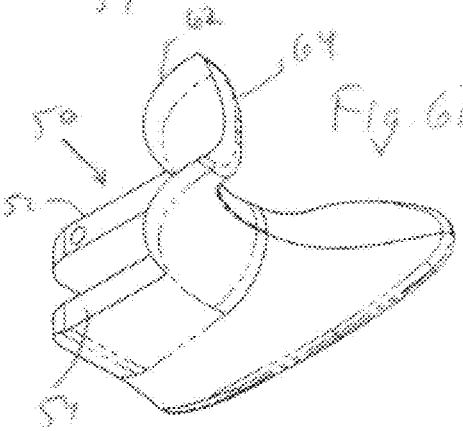
FIG. 6D is a perspective view of the spur shown in FIG. 6A.
Figure 6E:
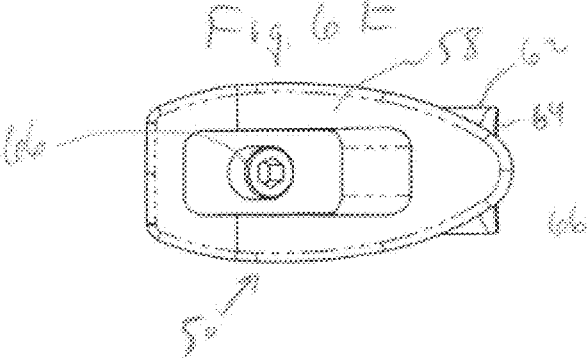
FIG. 6E is a bottom view of the spur shown in FIG. 6A.
Figure 6F:
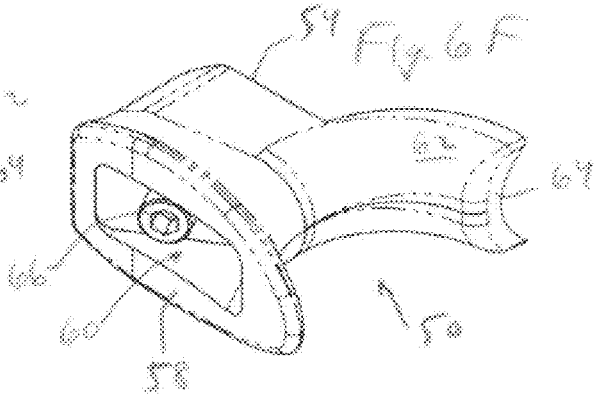
FIG. 6F is another perspective view of the spur shown in FIG. 6A.
Figure 7:
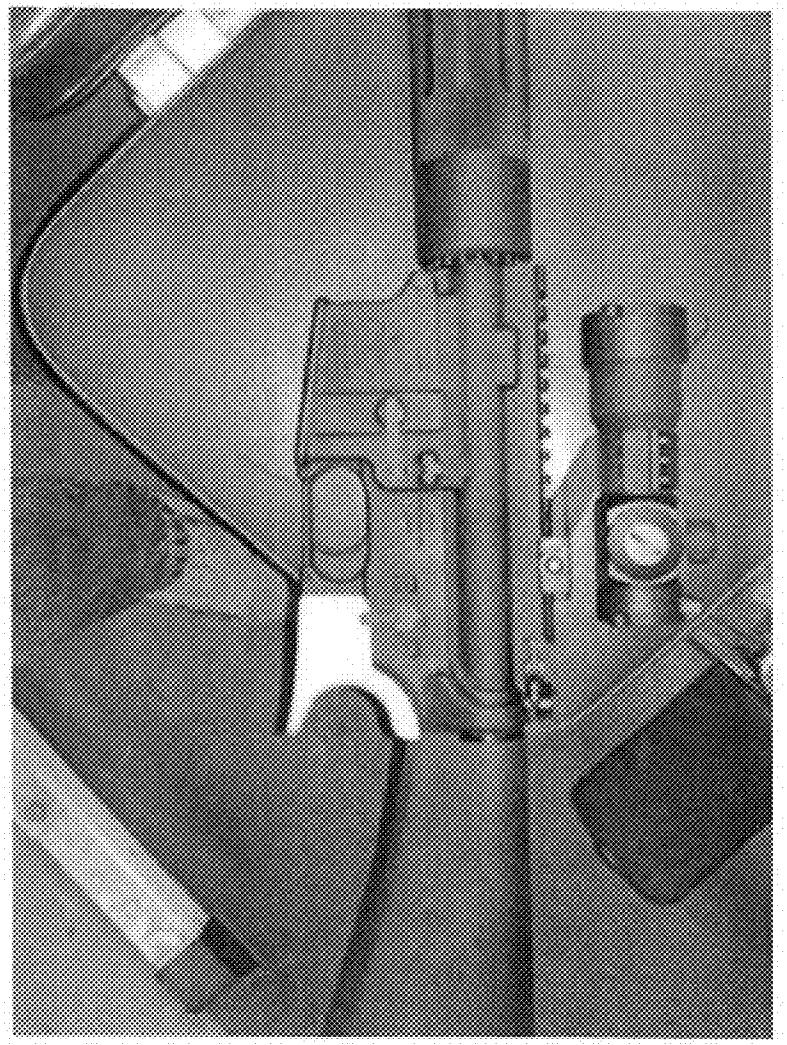
FIG. 7 is a side view of the AR-15 firearm with the receiver spur mounted thereon as shown in FIG. 5.
Figure 8:
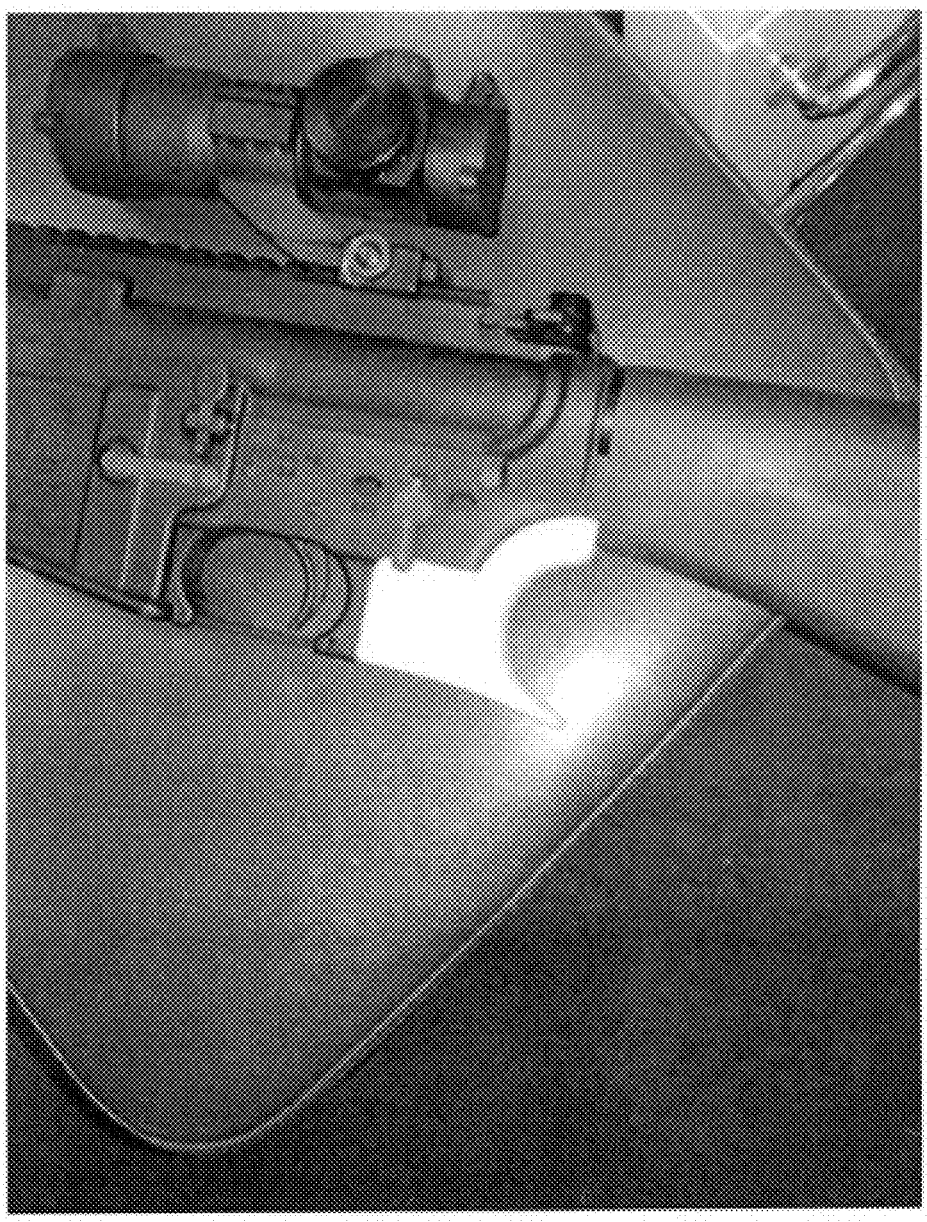
FIG. 8 is a perspective view of the AR-15 firearm with the receiver spur mounted thereon as shown in FIG. 5.
Figure 9:
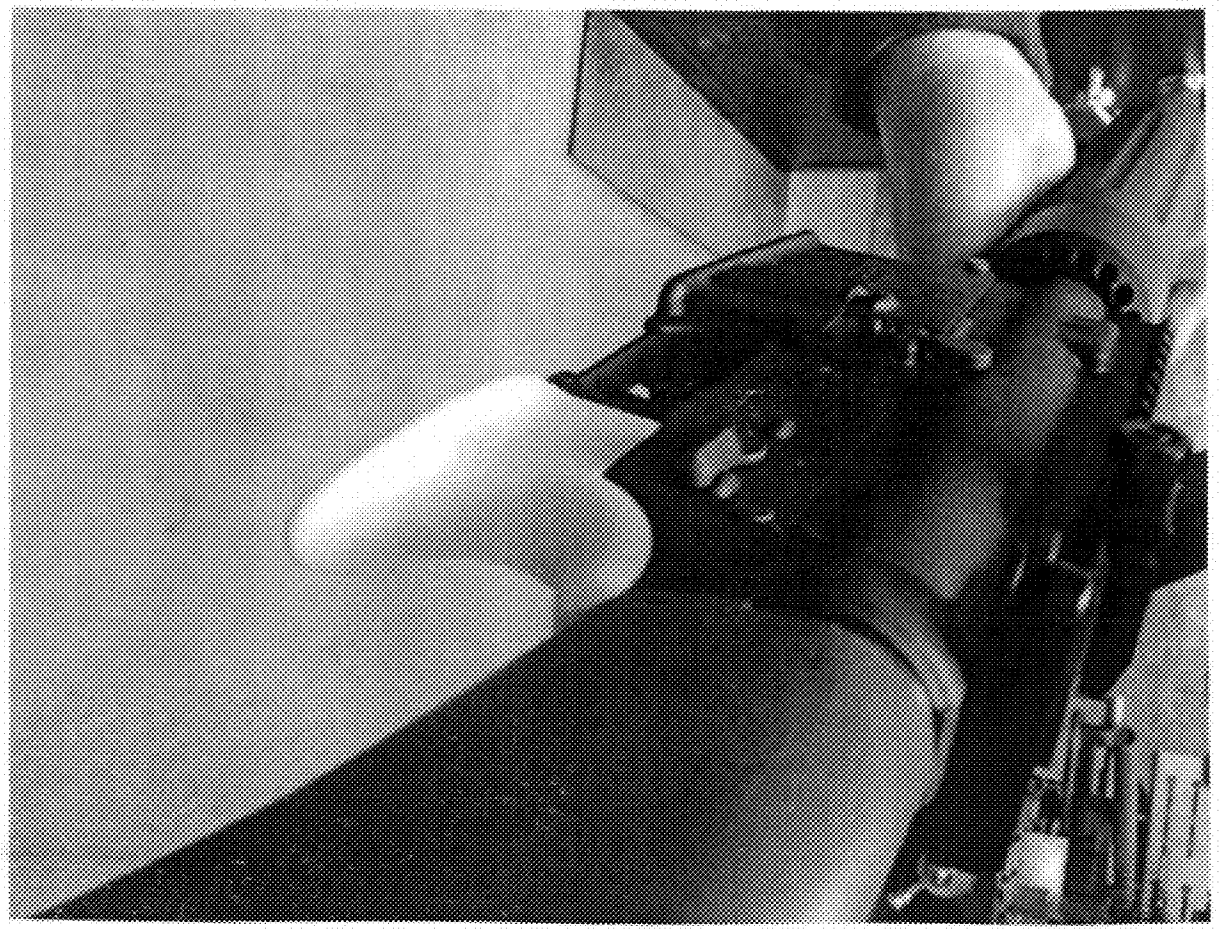
FIG. 9 is another perspective view of the AR-15 firearm with the receiver spur mounted thereon as shown in FIG. 5.

As best shown in FIGS. 6C, E, and F, the receiver spur 50 also includes a lower portion 58 preferably provided with a substantially centrally disposed recess 60. The recess 60 of the lower portion 58 may be partially defined by a beveled area that is co-planar with the beveled surface 56 extending between the walls 52, 54, as best shown in FIG. 6C.

The rear portion of the receiver spur 50 possesses a curved rear surface preferably curved in two orthogonal directions, as best shown in FIGS. 6C, D, and F. In one orthogonal direction (a line substantially orthogonal to the plane of movement of the trigger 18), the curve of the rear surface is substantially arcuate, as best shown in FIG. 6C. The receiver spur 50 also preferably includes a crook 62 that extends upwardly and rearwardly from the upper, rear portion of the receiver spur 50. The forward surface of the crook 62 is curved, preferably in substantially two orthogonal directions, and preferably possesses a configuration corresponding to the surface of the lower portion of the receiver 12 disposed immediately behind the lug 30, as is best shown in FIGS. 3 and 4. As such, the forward surface of the crook 62 preferably conformingly abuts the rounded surface of the lower portion of the receiver 12 located immediately behind the lug 30. The rear surface of the crook 62 is also curved, also preferably in two orthogonal directions, as best shown in FIGS. 6C, D, and F. The rear surface of the crook 62 is preferably substantially coextensive with and defines a continuous portion of the rear surface of the receiver spur 50. The distal end 64 of the crook 62 is preferably adapted to abut the front edge of a stock 16, as best shown in FIGS. 5 and 7-11.

The receiver spur 50 may be mounted to the lower portion of the receiver 12 by means of a machine screw or bolt 66 that is similar to the machine screw or bolt 34 shown in FIG. 3. A bore hole extends between the beveled area of the recess 60 to the beveled surface 56 extending between the walls 52, 54. The machine screw or bolt 66 extends through the bore hole and is oriented and adapted to extend into the threaded hole 32 of the lug 30 to selectively secure the receiver spur 50 to the lower portion of the receiver 12. Alternatively, the receiver spur 50 may be mounted to the lower portion of the receiver 12 by means of an adhesive placed within the cavity formed by the walls 52, 54 and the beveled surface 56 and preferably also against the front curved surface of the crook 62.

It will be appreciated from viewing FIGS. 6A, B, D, and F that the lower portion 58 of the receiver spur 50 is flared slightly outwardly. Such a configuration helps position a person's hand on the receiver spur 50 and inhibits the hand from sliding downwardly with respect to the receiver spur 50.

Figure 10:
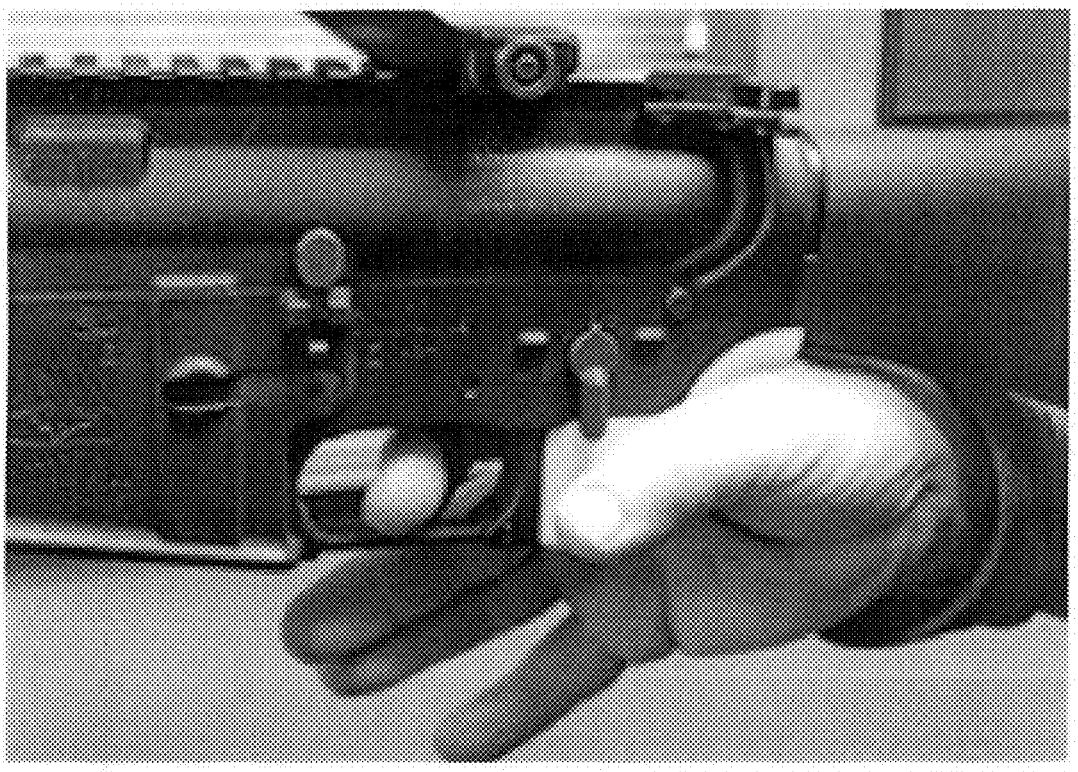
FIG. 10 is a side view of the AR-15 firearm with the receiver spur mounted thereon as shown in FIG. 5 illustrating how a human hand may be placed against the receiver spur with the index finger or forefinger of the hand operating the trigger.
Figure 11:
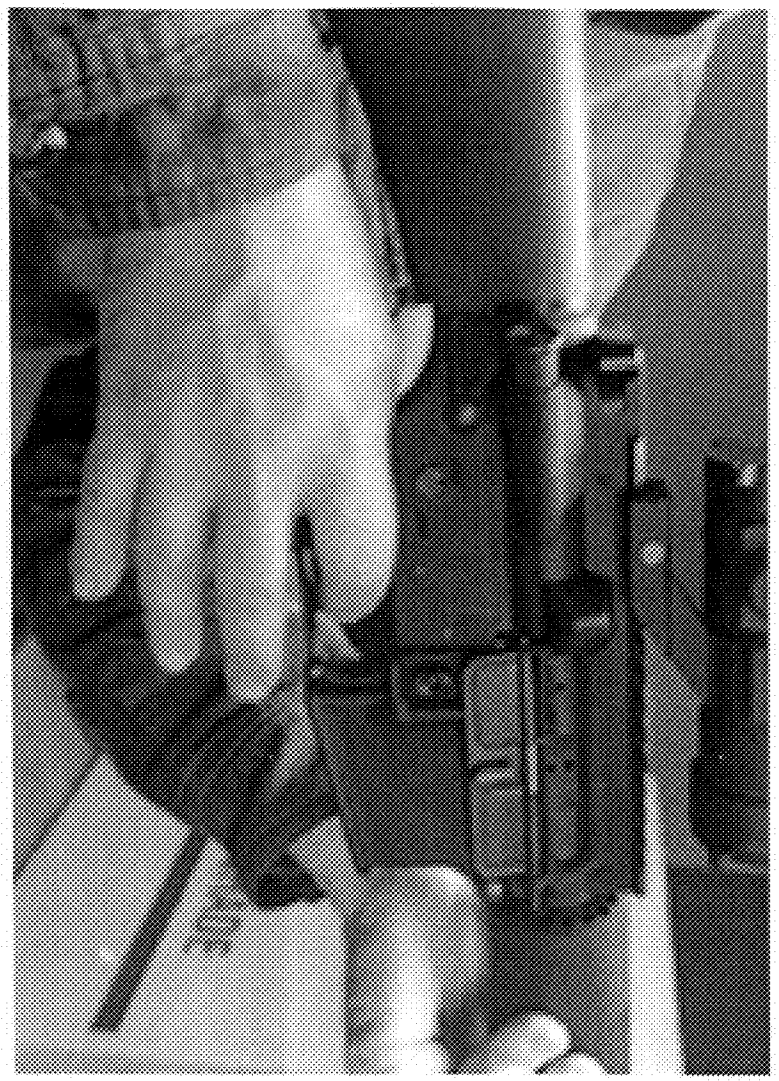
FIG. 11 is a reverse view of the AR-15 firearm with the receiver spur shown in FIG. 10, again showing how a human hand may be placed against the receiver spur with the index finger or forefinger of the hand operating the trigger.

It will also be appreciated from reviewing FIGS. 5 and 7-10 that the receiver spur 30 provides a grip for the person intending to fire the AR-15 firearm, but that the receiver spur 50 is not a "pistol style grip". Moreover, when the receiver spur 50 is mounted to the lower portion of the receiver 12, and a person grips the receiver spur 50 in a firing position with the index finger or forefinger extending to and around the trigger 18, as best shown in FIG. 10, the web of the trigger hand is not positioned below the uppermost exposed portion of the trigger 18.

The present invention contemplates that the receiver spur 50 may be fashioned of a single, unitary, integrally formed body. Such body may be fashioned of a variety of materials such as wood, rubber, plastic, and metal. In a preferred embodiment, the body is formed of nylon 6/6, which is impervious to oils and solvents normally used in connection with and around firearms. Alternatively, the receiver spur 50 may be fashioned of two or more pieces of the same or different materials secured together by adhesive, screws, bolts, snap-fit connectors, or other fastening members.

While various embodiments of the present invention have been described herein, it will be appreciated that the invention includes embodiments other than those specifically illustrated or described and that changes in the form and arrangement of parts and the specific manner of practicing the invention may be varied without departing from the nature or scope of the invention. Consequently, the invention may be practiced otherwise than is specifically described above.

We claim:

1. A hand grip adapted to be mounted on a receiver of a firearm including a trigger moveable in a plane between a forward position and a rearward position, the trigger depending from an underside of the receiver for actuating a firing sequence of the firearm, and including a trigger guard partially surrounding the trigger and secured to the underside of the receiver, the receiver possessing a magazine mouth disposed on the underside of the receiver and forward of the trigger and adapted to selectively receive and secure a detachable box magazine containing a plurality of cartridges, the receiver further possessing a lug depending from the underside of the receiver and rearward of the trigger and the trigger guard and adapted to engage a handle, the lug possessing a pair of opposing, parallel, side walls and possessing a beveled lower surface extending between the side walls and the lug having a threaded hole therein, the threaded hole adapted to receive a threaded fastening member for securing the handle to the lug, the hand grip consisting essentially of a unitary and integrally formed block possessing:

a front portion;

an upper portion;

a pair of spaced, substantially parallel, planar walls disposed on a said front portion and said upper portion thereof and a beveled block surface disposed and extending between said planar walls, said planar walls and said beveled block surface forming a cavity adapted and configured to substantially conformingly receive the lug therein;

a lower portion;

a rear portion possessing a rear end having a rearward facing surface extending from said upper portion to said lower portion and curved throughout such extent in a saddle shaped configuration; and a borehole extending therethrough from said lower portion to said beveled block surface, said borehole adapted to receive a threaded fastening member therein that may selectively, threadably extend into the threaded hole so as to selectively secure the block to the lug;

the block adapted to be disposed relative to the receiver such that the lug depends conformingly into the cavity thereof, such that the front portion thereof substantially abuts the trigger guard, such that a threaded fastening member may extend through the borehole and into the threaded hole to selectively secure the block to the lug, and such that when the block is so disposed, a person may grasp the block with the rearward facing surface abutting the webbed region of the person's hand between the thumb and the index finger and while in such an abutting relationship permit the distal end of the forefinger to extend to and around the trigger wherein the block is sized and configured such that, when the block is so disposed, the entire forward to rearward extent of the block is located underneath the receiver and a lowermost bottom surface of said block is substantially entirely coextensive with the lowest portion of the trigger guard.

2. The hand grip according to claim 1 wherein said lower portion possesses a recessed region and wherein the borehole extends from the recessed region to the beveled block surface.

3. The hand grip according to claim 1 wherein the underside of the receiver includes a rounded surface immediately behind the lug and wherein the block includes an upwardly and rearwardly extending crook possessing a forward facing surface configured to conformingly abut said rounded surface.

4. The hand grip according to claim 1 wherein the rearward facing surface possesses a substantially arcuate profile about a line substantially orthogonal to the plane of movement of the trigger when the block is so disposed.

5. A firearm including a receiver, a moveable trigger depending from an underside of the receiver for actuating a firing sequence of the firearm, and a trigger guard partially surrounding the trigger and secured to the underside of the receiver, the receiver possessing a magazine mouth disposed on the underside of the receiver and forward of the trigger and adapted to selectively receive and secure a detachable box magazine containing a plurality of cartridges, the receiver further possessing a lug depending from the underside of the receiver and rearward of the trigger and the trigger guard, the firearm further including a handle consisting essentially of:

a unitary and integrally formed block discrete from the receiver, said block possessing a lowermost bottom surface, a first surface conformingly abutting the trigger guard and the underside of the receiver rearward of the trigger guard, and possessing a second surface possessing a saddle shaped configuration and adapted to abuttingly receive the webbed region of a person's hand between the thumb and the index finger, and when the webbed region is so received, to permit the person's index finger to extend to and around the trigger, the entire forward to rearward extent of said block disposed entirely directly underneath the receiver, and substantially the entire lowermost bottom surface of said block being substantially coextensive with the lowest portion of the trigger guard.

6. In a firearm having a receiver, a trigger moveable substantially in a plane, and a trigger guard secured to an underside of the receiver, the improvement comprising a hand grip consisting essentially of:

a unitary and integrally formed block discrete from the receiver, said block secured to the underside of the receiver rearward of the trigger guard, said block possessing a rearward facing curved surface adapted to abuttingly and conformingly receive the webbed region of a person's hand between the thumb and an index finger and, while in such abutting and conforming relation, the webbed region is directly underneath the receiver and the distal end of the person's index finger is capable of extending to and around the trigger, said block having a lowermost bottom surface substantially entirely coextensive with the lowest portion of the trigger guard the entire forward to rearward extent of said block disposed entirely directly underneath the receiver.

7. The improvement in the firearm according to claim 6 wherein the block is secured to the receiver of the firearm by an adhesive.

8. The improvement in the firearm according to claim 6 wherein the block is secured to the receiver of the firearm by a threaded fastening member.

9. The improvement in the firearm according to claim 6 wherein the rearward facing curved surface possesses a saddle shaped configuration.

10. The improvement in the firearm according to claim 6 wherein the rearward facing curved surface possesses a substantially arcuate profile about a line substantially orthogonal to the plane of movement of the trigger.

11. A hand grip mounted on a firearm having a receiver and a trigger depending from the receiver, at a location immediately rearward of the trigger and directly beneath the receiver, said hand grip consisting essentially of:

a unitary and integrally formed block disposed entirely beneath the receiver and possessing (a) a top surface;
(b) a bottom surface;
(c) a front surface;
(d) a rear surface;
(e) a right side surface; and
(f) a left side surface;

the top surface conjoining the front, rear, right side, and left side surfaces, but not the bottom surface, and the bottom surface conjoining the front, rear, right side, and left side surfaces, but not the top surface, the rear surface curved in a saddle shaped configuration substantially the entire extent from the region of conjoinder with the top surface to the region of conjoinder with the bottom surface the bottom surface being substantially coextensive with the lowest portion of the trigger guard.

12. The hand grip according to claim 4 wherein the rear surface possesses a substantially arcuate profile when viewed from either the right side or the left side.

* * * * *